US010461418B2

(12) United States Patent
Hwang et al.

(10) Patent No.: US 10,461,418 B2
(45) Date of Patent: Oct. 29, 2019

(54) PHOTONIC MICROWAVE TIME DELAY APPARATUS AND METHOD THEREOF

(71) Applicant: National Cheng Kung University, Tainan (TW)

(72) Inventors: Sheng-Kwang Hwang, Tainan (TW); Kun-Lin Hsieh, Pitou Township (TW); Chin-Lung Yang, Tainan (TW)

(73) Assignee: National Cheng Kung University, Tainan (TW)

( * ) Notice: Subject to any disclaimer, the term of this patent is extended or adjusted under 35 U.S.C. 154(b) by 281 days.

(21) Appl. No.: 15/716,136

(22) Filed: Sep. 26, 2017

(65) Prior Publication Data

US 2018/0277949 A1 Sep. 27, 2018

(30) Foreign Application Priority Data

Mar. 23, 2017 (TW) ..... 106109830 A

(51) Int. Cl.
*H01Q 3/26* (2006.01)
*H01Q 3/34* (2006.01)
(Continued)

(52) U.S. Cl.
CPC ..... *H01Q 3/2682* (2013.01); *H01Q 3/2676* (2013.01); *H01Q 3/34* (2013.01);
(Continued)

(58) Field of Classification Search
CPC ..... H01Q 3/2676; H01Q 3/2682; H01Q 3/22; H01Q 3/2694; H01Q 3/46; G02B 6/2861; G02B 6/12004; H04B 10/61; H04B 10/2575; H04B 10/503; H04J 14/0213; G01S 2007/4065; G01S 7/4818; H01S 3/302; H04L 7/0075
See application file for complete search history.

(56) References Cited

U.S. PATENT DOCUMENTS 5,333,000 A * 7/1994 Hietala ..... G02F 2/02 342/368
6,320,539 B1 * 11/2001 Matthews ..... H01O 3/2676 342/375

(Continued)

OTHER PUBLICATIONS

Office Action of corresponding TW application, published on Nov. 22, 2017.

*Primary Examiner* — Olumide Ajibade Akonai
(74) *Attorney, Agent, or Firm* — Wang Law Firm, Inc.

(57) ABSTRACT

A photonic microwave time delay apparatus and method thereof are disclosed. The microwave-modulated optical signal generation module of the photonic microwave time delay apparatus generates a microwave-modulated optical signal. The microwave-modulated optical signal is injected into the photonic microwave time delay module of the photonic microwave time delay apparatus, wherein the photonic microwave time delay module includes a microwave-time-delay laser. The optical power and carrier frequency of the microwave-modulated optical signal are adjusted so as to excite the laser cavity resonance red-shift effect in the microwave-time-delay laser. Under such operation, the microwave-time-delay laser emits a microwave-modulated optical signal with a microwave time delay.

10 Claims, 12 Drawing Sheets

(51) Int. Cl.
*H01Q 15/14* (2006.01)
*H01Q 3/22* (2006.01)

(52) U.S. Cl.
CPC ..... *H01Q 15/14* (2013.01); *H01Q 3/22* (2013.01); *H01Q 3/2694* (2013.01)

(56) References Cited

U.S. PATENT DOCUMENTS

| | | | | |
|---|---|---|---|---|
| 8,779,977 | B2 * | 7/2014 | Zhou | H01Q 3/2676 342/368 |
| 9,166,678 | B1 * | 10/2015 | Fish | H04B 10/00 |
| 9,288,557 | B2 * | 3/2016 | Zhou | H04Q 11/0003 |
| 2007/0280704 | A1 * | 12/2007 | Fitzgerald | H01Q 3/2676 398/198 |
| 2009/0027268 | A1 * | 1/2009 | Coward | H01Q 3/22 342/375 |
| 2011/0097078 | A1 * | 4/2011 | Eliyahu | G01R 29/26 398/25 |
| 2012/0162662 | A1 | 6/2012 | Johnson et al. | |
| 2015/0244331 | A1 * | 8/2015 | Hwang | H03F 3/08 330/308 |
| 2018/0180655 | A1 * | 6/2018 | Kuse | G01R 29/26 |

* cited by examiner

PHOTONIC MICROWAVE TIME DELAY APPARATUS AND METHOD THEREOF

CROSS-REFERENCE TO RELATED APPLICATION

This application claims priority from Taiwan Patent Application No. 106109830, filed on Mar. 23, 2017 in Taiwan Intellectual Property Office, the contents of which are hereby incorporated by reference in their entirety.

BACKGROUND OF THE INVENTION

1. Field of the Invention

The present invention relates to a photonic microwave time delay apparatus and method thereof using, particularly, the laser cavity resonance red-shift effect in semiconductor lasers subject to external optical injection.

2. Description of the Related Art

The popularity of wireless devices and networks has greatly changed the way of life for human beings over the past years, and the convenience they bring has in turn prompted the dramatic enhancement of data traffic over the communication networks. According to the report released by a leading telecommunication manufacturer, Ericsson, the data traffic of the wireless communication has increased by 50% in the third quarter of 2016 as compared with that in the third quarter of 2015. With the development of the "Internet of Things (IoT)" and the demand increase of high-quality video transmission, the report predicted that the data traffic of the wireless communication will increase by 10 folds in 2022. Such information shows that how to enhance the transmission efficiency and bandwidth of the wireless networks has become a major issue and challenge.

For current wireless communication systems, the operating frequencies of the microwave carriers are mostly below 6 GHz, which limits the enhancement of the communication bandwidth and therefore restricts the capability of the current systems to support the continuously increasing requirement of communication capacity. In order to meet the aforementioned data traffic demand, telecommunication operators and manufacturers have proposed to use high-frequency microwave signals as carriers (for example, Samsung and Nokia have proposed to use 28 and 70 GHz, respectively) for the next-generation wireless communication systems. The adoption of high-frequency microwave signals not only provides wider communication bandwidth (for example, the "IEEE 802.11 ad" uses microwave carriers at 60 GHz with a bandwidth of 5 GHz), but also offers the feasibility for wireless device miniaturization. However, limited by the inherent bandwidth provided by electronic devices, it becomes considerably difficult to develop the required functionalities for high-frequency microwave signals using electronic devices, which therefore significantly increases the cost to construct and maintain the wireless systems. Owing to the intrinsic nature of photonics, many research groups have developed a variety of different functionalities for high-frequency microwave signals using different photonic approaches and devices over the past years. These studies have demonstrated that the highest microwave frequency the photonic devices can process is much higher than that the electronic devices can do. This suggests that photonics-based devices can not only process high-frequency microwave signals effectively but also considerably reduce the cost to construct and maintain wireless communication systems using high-frequency microwave signals as carriers.

In addition to the aforementioned method adopting high-frequency microwave signals as carriers, the multi-input-multi-output technology has also been proposed to considerably improve the spectral efficiency of wireless transmission in order to cope with the demand of high communication capacity. Such a technology employs phased-array antennas to realize beamforming, which not only enhances the detection sensitivity of data but also avoid the interference between different wireless channels. In this manner, the multi-input-multi-output technology enables multiple users to transmit/receive data simultaneously so as to improve the overall spectral efficiency. Wireless systems based on phased-array antennas are composed of multiple antennas. By properly adjusting the phase difference between microwave radiations from different antennas, a highly directional microwave signal can be consequently formed due to electromagnetic interference between different microwave radiations. The angular direction can be adjusted by adjusting the level of the phase difference so as to achieve spatial division multiplexing and therefore to enhance the spectral efficiency. To apply the multi-input-multi-output technology to the aforementioned wireless communication systems adopting high-frequency microwave signals, the microwave time delay technique must be develop in order to mitigate the beam squint effect which reduces the quality of wireless communication.

Two commonly adopted apparatuses and methods to introduce microwave time delays using photonic devices are briefly described as follows.

(1) Coherent Population Oscillation

By injecting an optical signal carrying a low-frequency ($f_{cpo}$) microwave signal into a semiconductor optical amplifier, gain modulation at a frequency of $f_{cpo}$ is created inside the semiconductor optical amplifier, which in turn generates coherent population oscillation and induces the slow-light effect. At the same time, by injecting another optical signal carrying a high-frequency ($f_{op}$) microwave signal into the semiconductor optical amplifier, the high-frequency microwave signal is modulated due to the cross-gain modulation effect, which generate two additional microwave components at $f_{op} \pm f_{cpo}$ with their optical phases affected by the slow-light effect. By changing the bias current of the semiconductor optical amplifier, the level of the slow-light effect is varied, which in turn adjusts the optical phases and thus the microwave time delay of the two additional microwave signals. However, limited by the carrier lifetime in the semiconductor optical amplifier, the range of the operating microwave frequency for this method is restricted within a few hundred megahertz, which is not suitable for wireless systems adopting high-frequency microwave carriers. In addition, since this method requires not only a high-frequency ($f_{op}$) microwave signal but also an optical signal carrying a low-frequency ($k_{cpo}$) microwave signal, the extent of wireless system complexity and the cost of wireless system construction will greatly increase.

(2) Stimulated Brillouin Scattering

By sending an optical pump with a power of 10 to 20 mW and a frequency of $f_{pump}$ into an optical fiber of 10 to 20 km, a nonlinear effect, stimulated Brillouin scattering, can be excited, which induces gain and absorption resonances at $f_{pump}+f_B$ and $f_{pump}-f_B$, respectively. Meanwhile, by sending an optical single-sideband modulation signal carrying a microwave signal into the optical fiber, where the modulation sideband appears around the gain resonance at $f_{pump}+f_B$, not only the optical power of the modulation sideband is amplified due to the gain resonance, but also the optical phase of the modulation sideband is altered by the change in dispersion resulting from the gain resonance. By changing the optical power or frequency of the optical pump, the aforementioned dispersion resulting from the gain resonance can be varied, which therefore can be used to adjust the optical phase of the modulation sideband and in turn to manipulate the microwave time delay of the microwave signal carried by the optical single-sideband modulation signal. However, limited by the physical nature of the stimulated Brillouin scattering, the range of the operating microwave frequency for this method is restricted below 100 megahertz, which is not suitable for wireless systems adopting high-frequency microwave carriers. In addition, since this method requires an optical pump with high power and an optical fiber of long length, not only the level of system complexity, construction cost, and power consumption will greatly increase, but also the extent of system miniaturization will become challenging.

SUMMARY OF THE INVENTION

According to the problems and challenges encountered in prior arts, the purpose of the present invention is to provide an apparatus and a method thereof for microwave time delays based on the red-shifted laser cavity resonance effect in a semiconductor laser induced by external optical injection. Only a typical and commercially available semiconductor laser is required as the key component, which could be a Fabry Perot laser, a distributed feedback laser, a vertical cavity surface emitting laser, a quantum-well laser, a quantum-dash laser, or a quantum-dot laser. No specific or high-speed semiconductor laser is necessary to carry out microwave time delays through the red-shifted laser cavity resonance effect in an optically injected semiconductor laser. The method of the present invention is to inject an optical input, which is an optical signal carrying a time-to-be-delayed microwave signal at $f_m$ generated by a microwave-modulated optical signal generation module, into the semiconductor laser under a proper injection frequency and a proper injection power. In this manner, the optical gain necessary for the semiconductor laser is reduced, which decreases the laser cavity resonance frequency of the semiconductor laser through the antiguidance effect and therefore induces the so-called laser cavity resonance red-shift effect. Such a laser cavity resonance red-shift effect not only amplifies the optical power but also shifts the optical phase of the lower-frequency modulation sideband of the optical input, the latter of which suggests that the microwave phase of the microwave signal carried by the optical input changes accordingly. Such a microwave phase shift is approximately linear over a few gigahertz, leading to a constant microwave time delay over such a frequency range. Hence, an optical output, which is an optical signal carrying a time-delayed microwave signal at $f_m$, is generated out of the semiconductor laser. By changing the power or carrier frequency of the optical input, the level of the laser cavity resonance red-shift effect is varied. Accordingly, the optical phase of the lower-frequency modulation sideband of the optical input is adjusted and therefore the microwave time delay of the microwave signal carried by the optical input is manipulated. Owing to the all-optical nature of the apparatus and method of the present invention, not only the number of the required yet expensive electronic devices can be reduced, but also the bandwidth limitation resulting from the use of electronic devices can be mitigated. Therefore, the apparatus and method of the present invention can be applied to introduce a microwave time delay to a microwave signal at a microwave frequency ranging from a few gigahertz to hundreds of gigahertz, and therefore can be dynamically reconfigured for different wireless communication networks adopting different microwave frequencies. In addition, the linewidth and phase noise of the time-delayed microwave signal are kept the same as those of the time-to-be-delayed microwave signal, making the apparatus and method of the present invention beneficial to wireless communication systems adopting advanced modulation formats for data transmission in order to further increase the communication capacity. Furthermore, since the lower-frequency modulation sideband is amplified while a microwave time delay is introduced, the optical modulation depth of the optical output can be made close to 100%. This indicates that, under the same optical power level received by a photodetector, the power of the microwave signal is significantly higher after microwave time delay, which is advantageous in improving the detection sensitivity, fiber transmission distance, and link gain of a communication network. Moreover, since the power of the lower-frequency modulation sideband is amplified after microwave time delay, the optical output therefore possesses an optical single-sideband modulation feature, which is highly preferable for applications where fiber distribution of the optical output is necessary in order to mitigate microwave power fading. In addition, the level of the microwave time delay can be continuously adjusted through changing the power or carrier frequency of the optical input, which is beneficial not only to reduce the complexity of the system operation but also to continuously steer the beam pointing angle of phased-array antennas.

According to the aforementioned purposes, the present invention provides a photonic microwave time delay apparatus which includes a photonic microwave time delay module to convert an optical input, which is an optical signal carrying a time-to-be-delayed microwave signal, into an optical output, which is an optical signal carrying a time-delayed microwave signal. The photonic microwave time delay module includes a microwave-time-delay laser. The optical power and carrier frequency of the optical input are adjusted so as to excite the laser cavity resonance red-shift effect in the microwave-time-delay laser.

Preferably, the photonic microwave time delay apparatus may include a microwave-modulated optical signal generation module to generate the optical input. The microwave-modulated optical signal generation module may include a laser to generate a continuous-wave optical signal, an optical polarization controller to adjust the polarization of the continuous-wave optical signal, a microwave signal generator to generate the time-to-be-delayed microwave signal, and an optical modulator to superimpose the time-to-be-delayed microwave signal onto the continuous-wave optical signal in order to generate the optical input.

Preferably, the photonic microwave time delay module may further include an optical power adjuster to adjust the optical power of the optical input and an optical polarization controller to adjust the polarization of the optical input before sending the optical input into the microwave-time-delay laser.

Preferably, the optical power adjuster may include an active optical device or a passive optical device. The active optical device may be an optical power amplifier and the passive optical device may be an optical power attenuator.

Preferably, the photonic microwave time delay module may further include an optical path controller, connected to the microwave-time-delay laser, to unidirectionally direct the optical input toward the microwave-time-delay laser and also to unidirectionally direct the optical output toward an output port of the photonic microwave time delay apparatus.

Preferably, the optical path controller may be an optical circulator, and the microwave-time-delay laser may be a semiconductor laser.

In addition, according to the aforementioned purpose, the present invention further provides a photonic microwave time delay method which includes the following steps:

(1) using a microwave-modulated optical signal generation module to generate an optical input which is an optical signal carrying a time-to-be-delayed microwave signal, and (2) using a photonic microwave time delay module to convert the optical input into an optical output, which is an optical signal carrying a time-delayed microwave signal. The photonic microwave time delay module includes a microwave-time-delay laser. The optical power and carrier frequency of the optical input are adjusted so as to excite the laser cavity resonance red-shift effect in the microwave-time-delay laser.

Preferably, the step of using the microwave-modulated optical signal generation module to generate the optical input may include steps of:

(1) using a laser to generate a continuous-wave optical signal, (2) using an optical polarization controller to adjust the polarization of the continuous-wave optical signal, (3) using a microwave signal generator to generate the time-to-be-delayed microwave signal, and (4) using an optical modulator to superimpose the time-to-be-delayed microwave signal on the continuous-wave optical signal in order to generate the optical input.

Preferably, two more steps may also be included between the step of using the microwave-modulated optical signal generation module to generate the optical input and the step of using the photonic microwave time delay module to convert the optical input into the optical output:

(1) using an optical power adjuster to adjust the optical power of the optical input, and (2) using an optical polarization controller to adjust the polarization of the optical input.

Furthermore, in the step of using the microwave-time-delay laser to convert the optical input into the optical output, an optical path controller is also used to unidirectionally direct the optical input toward the microwave-time-delay laser, and to unidirectionally direct the optical output toward an output port.

Accordingly, the photonic microwave time delay apparatus and method based upon the present invention possess one or more of the following characteristics and advantages:

(1) The photonic microwave time delay apparatus of the present invention only requires a typical and commercially available semiconductor laser as the key component, which could be a Fabry Perot laser, a distributed feedback laser, a vertical cavity surface emitting laser, a quantum-well laser, a quantum-dash laser, or a quantum-dot laser. No specific or high-speed semiconductor laser is necessary to carry out microwave time delays through the laser cavity resonance red-shift effect in an optically injected semiconductor laser.

(2) Owing to the all-optical nature of the apparatus and method of the present invention, not only the number of the required yet expensive electronic devices can be reduced, but also the bandwidth limitation resulting from the use of electronic devices can be mitigated. Therefore, the apparatus and method of the present invention can be applied to introduce a microwave time delay to a microwave signal at a microwave frequency ranging from a few gigahertz to hundreds of gigahertz, and therefore can be dynamically reconfigured for different wireless communication networks adopting different microwave frequencies.

(3) The linewidth and phase noise of the time-delayed microwave signal are kept the same as those of the time-to-be-delayed microwave signal, making the apparatus and method of the present invention beneficial to wireless communication systems adopting advanced modulation formats for data transmission in order to further increase the communication capacity.

(4) The power of the microwave signal is significantly higher after microwave time delay, which is advantageous in improving the detection sensitivity, fiber transmission distance, and link gain of a communication network.

(5) After microwave time delay, the optical output possesses an optical single-sideband modulation feature, which is highly preferable for applications where fiber distribution of the optical output is necessary in order to mitigate microwave power fading.

(6) The level of the microwave time delay can be continuously adjusted through changing the optical power or carrier frequency of the optical input, which is beneficial not only to reduce the complexity of the system operation but also to continuously steer the beam pointing angle of phased-array antennas.

BRIEF DESCRIPTION OF THE DRAWINGS

The device structure, operating principle, and advantageous characteristics of the present invention are described with more details hereinafter with reference to the accompanying drawings that show various embodiments of the present invention as follows.

DETAILED DESCRIPTION OF THE PREFERRED EMBODIMENTS

To illustrate the device structure, operating principle, and advantageous characteristics of the present invention, a preferred embodiment and the corresponding drawings are provided with more details. The purpose of the drawings being used is for illustration, and they are not necessarily the real proportion and precise allocation of the embodiments of the present invention. Therefore, they should not be used to limit the privilege coverage of the practical embodiments of the present invention.

Figure 4:
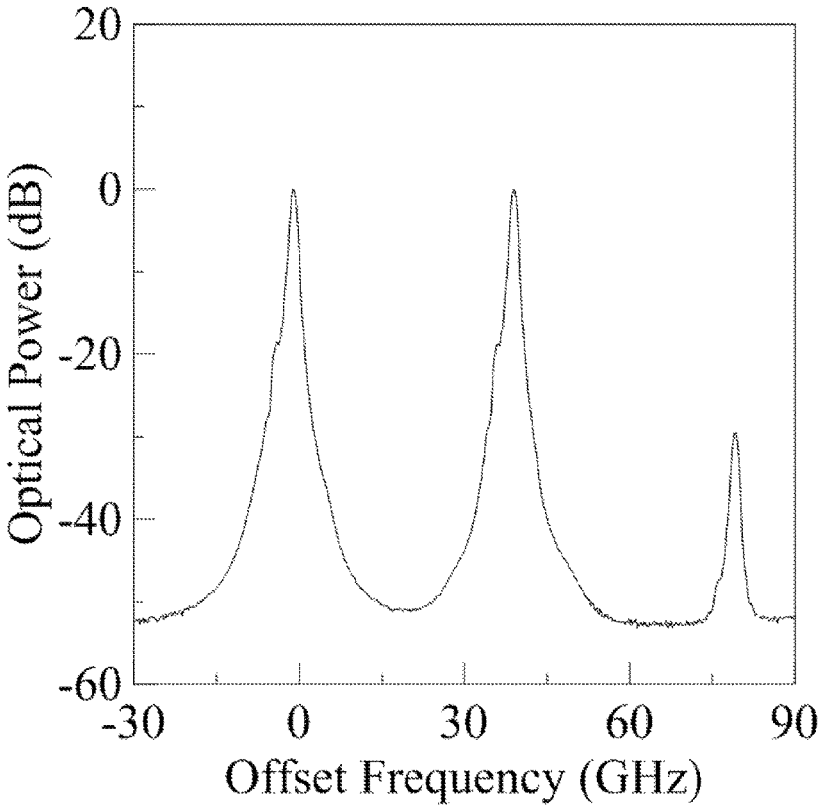
FIG. 4 shows an optical spectrum of a period-one nonlinear dynamical state when a microwave-time-delay laser is subject to an injection of a continuous-wave optical signal according to the preferred embodiment of the present invention. The x-axis is relative to the free-running frequency of the microwave-time-delay laser.
Figure 5:
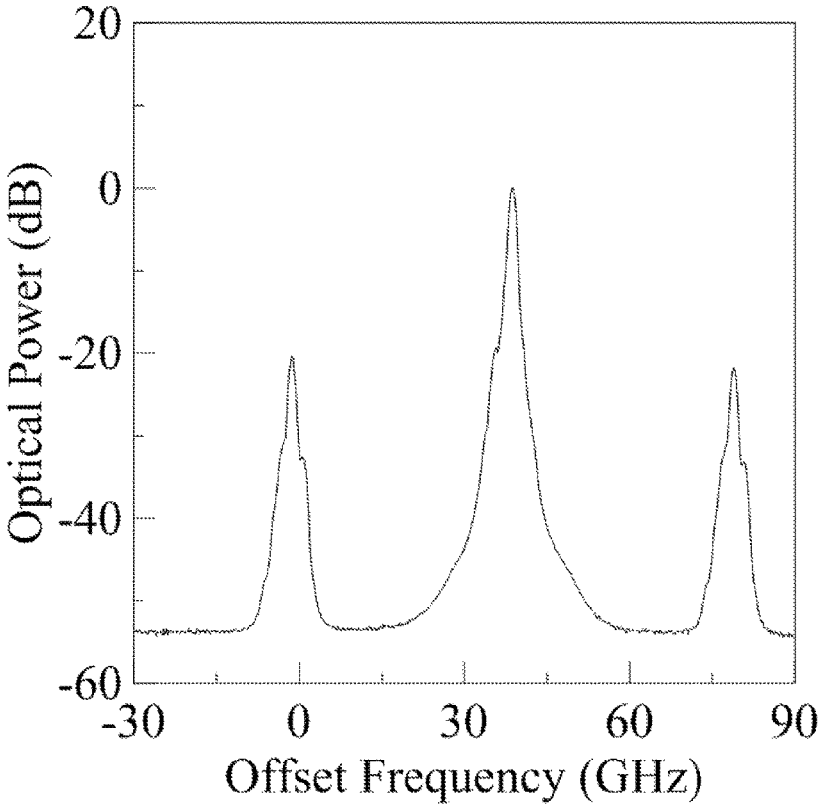
FIG. 5 shows an optical spectrum of an optical input, which is an optical signal carrying a time-to-be-delayed microwave signal generated by a microwave-modulated optical signal generation module, according to the preferred embodiment of the present invention. The x-axis is relative to the free-running frequency of the microwave-time-delay laser.
Figure 6:
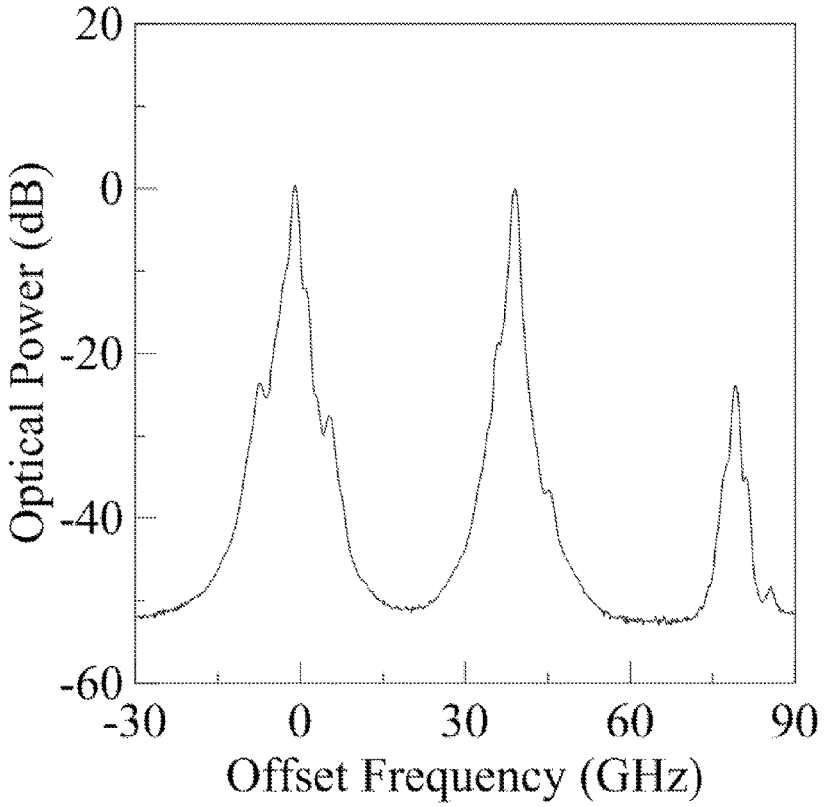
FIG. 6 shows an optical spectrum of an optical output, which is an optical signal carrying a time-delayed microwave signal out of the photonic microwave time delay apparatus, according to the preferred embodiment of the present invention. The x-axis is relative to the free-running frequency of the microwave-time-delay laser.
Figure 7:
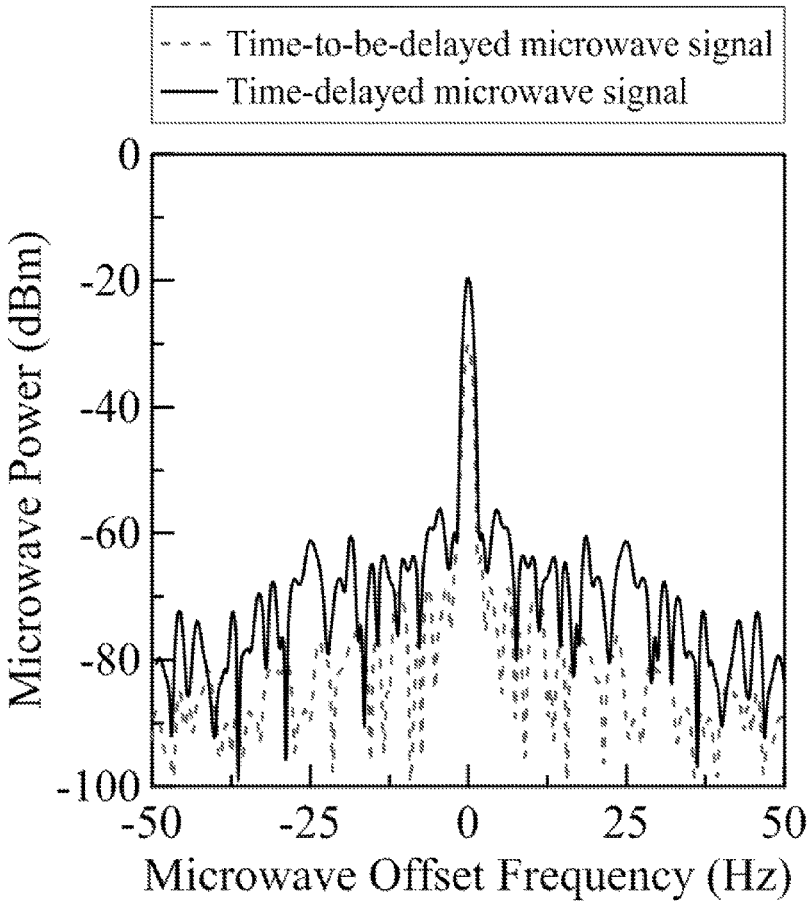
FIG. 7 shows microwave spectra, centering at 40 GHz, of the optical input and the optical output, respectively, according to the preferred embodiment of the present invention.
Figure 8:
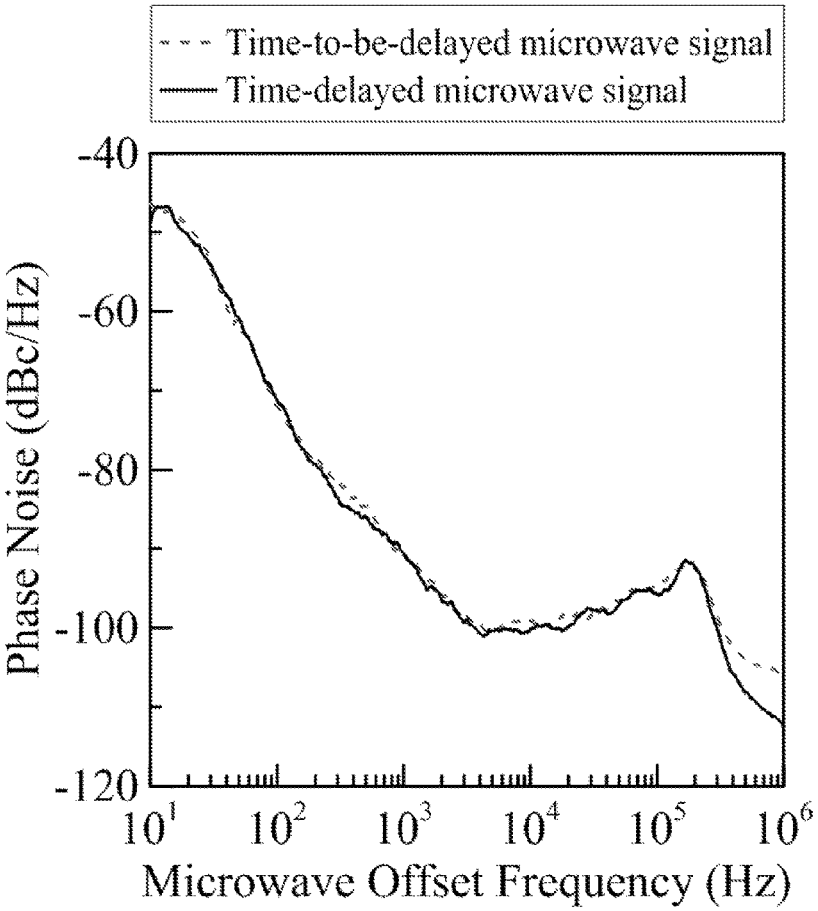
FIG. 8 shows phase noise in terms of the microwave offset frequency for the microwave signal before and after the microwave time delay process according to the preferred embodiment of the present invention.

Referring to FIG. 1, and FIG. 4 to FIG. 8, FIG. 1 is a schematic representation of a photonic microwave time delay apparatus according to the preferred embodiment of the present invention. FIG. 4 shows an optical spectrum of a period-one nonlinear dynamical state when a microwave-time-delay laser is subject to an injection of a continuous-wave optical signal according to the preferred embodiment of the present invention. FIG. 5 shows an optical spectrum of an optical input, which is an optical signal carrying a time-to-be-delayed microwave signal generated by a microwave-modulated optical signal generation module, according to the preferred embodiment of the present invention. FIG. 6 shows an optical spectrum of an optical output, which is an optical signal carrying a time-delayed microwave signal out of the photonic microwave time delay apparatus, according to the preferred embodiment of the present invention. FIG. 7 shows microwave spectra, centering at 40 GHz, of the optical input and the optical output, respectively, according to the preferred embodiment of the present invention. FIG. 8 shows phase noise in terms of the microwave offset frequency for the microwave signal before and after the microwave time delay process according to the preferred embodiment of the present invention.

Figure 1:
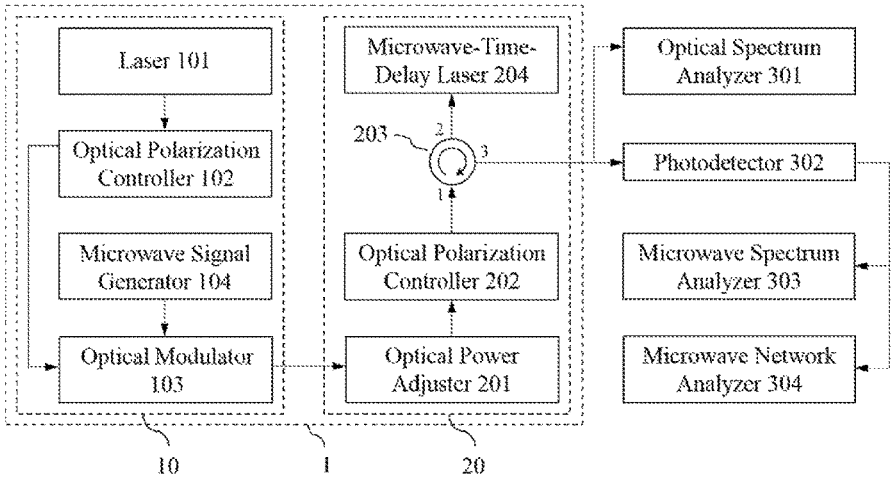
FIG. 1 is a schematic representation of a photonic microwave time delay apparatus according to a preferred embodiment of the present invention.
Figure 2:
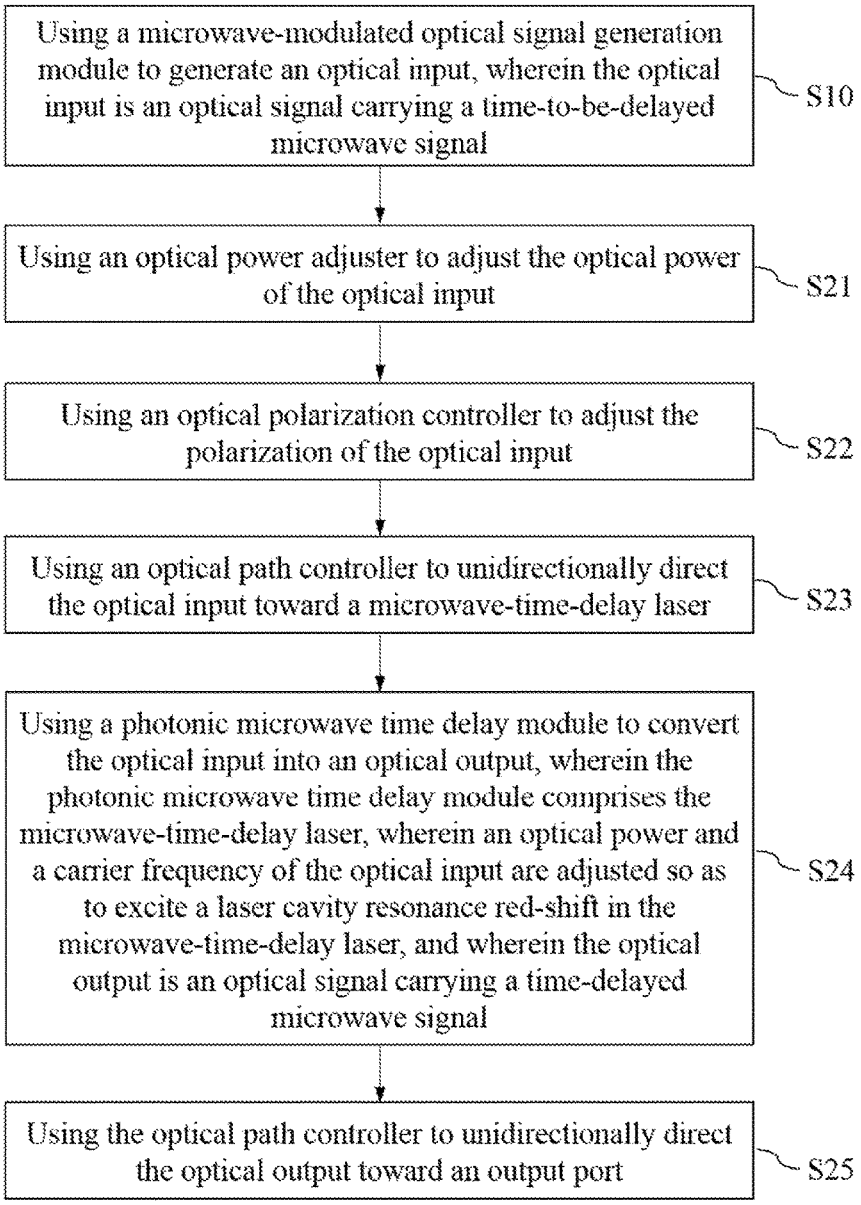
FIG. 2 is a first flow diagram showing a photonic microwave time delay method according to the preferred embodiment of the present invention.

As shown in FIG. 1, a photonic microwave time delay apparatus 1 includes a photonic microwave time delay module 20. The photonic microwave time delay module 20 converts an optical input, which is an optical signal carrying a time-to-be-delayed microwave signal, into an optical output, which is an optical signal carrying a time-delayed microwave signal. The photonic microwave time delay module 20 includes a microwave-time-delay laser 204. The optical power and carrier frequency of the optical input are adjusted so as to excite the laser cavity resonance red-shift effect in the microwave-time-delay laser 204. The microwave-time-delay laser 204 may be a semiconductor laser, which can be a Fabry Perot laser, a distributed feedback laser, a vertical cavity surface emitting laser, a quantum-well laser, a quantum-dash laser, or a quantum-dot laser. The photonic microwave time delay apparatus 1 may further include a microwave-modulated optical signal generation module 10 to generate the optical input.

Without any external perturbation, the microwave-time-delay laser 204 emits a single-frequency, continuous-wave optical signal. By injecting a continuous-wave optical signal into the microwave-time-delay laser 204, the optical injection signal pulls the intracavity field oscillation of the microwave-time-delay laser 204 toward the frequency of the optical injection signal owing to the injection pulling effect. On the other hand, the introduction of the optical injection signal reduces the necessary gain for the microwave-time-delay laser 204 from the free-running value, which leads to the increase in the refractive index of the laser cavity through the antiguidance effect. This in turn reduces the laser cavity resonance frequency of the microwave-time-delay laser 204, and therefore leads to the laser cavity resonance red-shift effect, which attempts to pull the intracavity field oscillation of the microwave-time-delay laser 204 toward the red-shifted laser cavity resonance frequency. Since the injection pulling effect and the laser cavity resonance red-shift effect mentioned above attempt to pull the intracavity field oscillation of the microwave-time-delay laser 204 toward different frequencies, dynamical competition and interaction between the two effects happen inside the microwave-time-delay laser 204, which considerably modifies the output behavior of the microwave-time-delay laser 204. Depending on the relative strength between the two effects, which can be altered through adjusting the optical power or carrier frequency of the optical injection signal, such an output behavior includes period-one nonlinear dynamics, stable injection locking dynamics, and chaotic dynamics. The photonic microwave time delay apparatus and method of the present invention take advantage of the laser cavity resonance red-shift effect induced in the microwave-time-delay laser 204 operating at either period-one nonlinear dynamics or stable injection locking dynamics to introduce a microwave phase shift and thus a microwave time delay to a microwave signal carried by a microwave-modulated optical signal. Since the underlying mechanisms are similar, the microwave-time-delay laser 204 operating at the period-one nonlinear dynamics is primarily used for the following demonstration. In the following explanations, the injection strength, $\xi_i$, indicates the power of an optical injection signal relative to that of the microwave-time-delay laser 204, and the detuning frequency, $f_i$, indicates the frequency of the optical injection signal relative to the free-running frequency of the microwave-time-delay laser 204, where the optical injection signal can be a continuous-wave optical signal or a microwave-modulated optical signal.

As an example, FIG. 4 shows an optical spectrum of a period-one nonlinear dynamical state when the microwave-time-delay laser 204 is subject to an injection of a continuous-wave optical signal $\xi_i$=0.68 and $f_i$=39.1 GHz. In addition to the regeneration of the continuous-wave optical signal at the offset frequency of 39.1 GHz due to the injection pulling effect, two oscillation sidebands, which are equally separated from the regeneration by an oscillation frequency $f_o$=40 GHz, sharply emerge at the offset frequency of −0.9 GHz and 79.1 GHz, respectively, due to the laser cavity resonance red-shift effect. Since the lower oscillation sideband typically appears a few gigahertz lower than the red-shifted laser cavity resonance, it is resonantly enhanced and thus becomes much stronger as opposed to its upper counterpart, and it also undergoes a significant optical phase shift. The photonic microwave time delay apparatus and method of the present invention mainly take advantage of the optical phase shift around the lower oscillation sideband so as to change the microwave phase shift and thus the microwave time delay of a microwave signal carried by a microwave-modulated optical signal.

Adjusting either $\xi_i$ or $f_i$ of the continuous-wave optical injection varies the level of the laser cavity resonance ref-shift effect, which in turn changes the frequency separation between adjacent frequency components (i.e., the oscillation frequency $f_o$) and the power of each frequency component, and therefore results in different characteristics of the period-one nonlinear dynamics of the microwave-time-delay laser 204. This suggests that the power of the lower oscillation sideband changes $\xi_i$ with or $f_i$, and that the optical phase shift around the lower oscillation sideband varies with $\xi_i$ or $f_i$ as well. Hence, the photonic microwave time delay apparatus and method of the present invention take advantage of such a physical feature and operation approach to adjust the microwave phase shift and thus the microwave time delay of a microwave signal carried by a microwave-modulated optical signal. In addition, since the oscillation frequency $f_0$ can be broadly and continuously adjusted from a few gigahertz to hundreds of gigahertz by simply changing $\xi_i$ and $f_i$, the photonic microwave time delay apparatus and method of the present invention can be applied to any microwave frequency within the aforementioned range and therefore can be dynamically reconfigurable for different wireless communication networks adopting different operating microwave frequencies.

For the purpose of the present invention, instead of using a continuous-wave optical signal to induce the laser cavity resonance red-shift effect in the microwave-time-delay laser 204, an optical input generated by the microwave-modulated optical signal generation module 10 is used. In FIG. 5 of the present embodiment, the optical input generated by the microwave-modulated optical signal generation module 10 may be an optical double-sideband signal. The frequency component of the optical double-sideband signal at the center is commonly referred to as the optical carrier. The two frequency components that possess the same optical power and appear away from the optical carrier by a modulation frequency $f_m$ are commonly referred to as the modulation sidebands. For the purpose of the present invention, the modulation frequency $f_m$ of the optical input can be different from the oscillation frequency $f_o$ of the period-one nonlinear dynamics.

As an example, the microwave-modulated optical signal generation module 10 may include a laser 101, an optical polarization controller 102, a microwave signal generator 104, and an optical modulator 103. The laser 101, which can be a tunable laser, generates a continuous-wave optical signal of a specific frequency and a specific power according to the operating requirement. To change the power of the continuous-wave optical signal, an optical power adjuster (not shown in FIG. 1) that is externally attached to or internally built inside the laser 101 can also be used. The optical polarization controller 102 receives the continuous-wave optical signal, adjusts the polarization of the continuous-wave optical signal, and outputs the continuous-wave optical signal. The microwave signal generator 104 generates a time-to-be-delayed microwave signal at $f_m$. The optical modulator 103 receives the continuous-wave optical signal and the time-to-be-delayed microwave signal, and superimposes the time-to-be-delayed microwave signal onto the continuous-wave optical signal to generate the optical input shown in FIG. 5.

In addition to the microwave-time-delay laser 204, the photonic microwave time delay module 20 may also include an optical power adjuster 201 and an optical polarization controller 202. The optical power adjuster 201 receives and adjusts the power of the optical input generated by the microwave-modulated optical signal generation module 10 in order to change the injection strength $\xi_i$. Varying the frequency of the continuous-wave optical signal generated by the laser 101 or the frequency of the output optical signal generated by the microwave-time-delay laser 204 changes the detuning frequency $f_i$. The optical power adjuster 201 may include an active optical device and/or a passive optical device to adjust the power of the optical input. The active optical device may be an optical power amplifier and the passive optical device may be an optical power attenuator. If the power of the optical input generated by the microwave-modulated optical signal generation module 10 is adequately high, the optical power adjuster 201 only needs an optical power attenuator to achieve the power adjustment. The optical polarization controller 202, connected to the optical power adjuster 201, receives the optical input after power adjustment by the optical power adjuster 201 and adjusts the polarization of the optical input so that the polarization of the optical input is aligned with that of the microwave-time-delay laser 204 in order to maximize the optical injection efficiency. After the polarization adjustment, the optical input is sent toward the microwave-time-delay laser 204.

In addition, the photonic microwave time delay module 20 may also include an optical path controller 203, connected to the microwave-time-delay laser 204, to unidirectionally direct the optical input toward the microwave-time-delay laser 204, and also to unidirectionally direct the optical output of the microwave-time-delay laser 204 toward an output port of the photonic microwave time delay apparatus 1. The optical path controller 203 may be an optical circulator. The optical output of the photonic microwave time delay module 20 can be split into two optical beams by an optical coupler (not shown in FIG. 1). One optical beam is sent into an optical spectrum analyzer 301 to analyze the optical spectrum of the optical output, and the other optical beam is sent into a photodetector 302 followed by a microwave spectrum analyzer 303 and a microwave network analyzer 304, respectively, to analyze the microwave spectrum (including microwave power, linewidth, and phase noise) and the microwave phase of the optical output.

As an example, if the next-generation wireless communication system adopts phase-arrayed antennas for wireless transmission, which uses a 40-GHz microwave signal as a carrier, an optical input carrying a time-to-be-delayed microwave signal at $f_m$=40 GHz, as shown in FIG. 5, can be generated, as the procedure described above, by superimposing a 40-GHz microwave signal generated by the microwave signal generator 104 onto a continuous-wave optical signal generated by the laser 101 through the optical modulator 103. The optical power of the modulation sidebands is typically much lower than that of the optical carrier. The optical power difference between the modulation sidebands and the optical carrier is about 20 dB in this demonstration according to the preferred embodiment of the present invention, indicating an optical modulation depth of 20%. As shown in FIG. 6, by injecting the optical input into the microwave-time-delay laser 204 under the same injection condition of ($\xi_i$, $f_i$)=(0.68, 39.1 GHz) considered in FIG. 4, the optical carrier of the optical input invokes a period-one nonlinear dynamical state with frequency components closely similar to the one shown in FIG. 4, where the optical carrier of the optical input regenerates at the offset frequency of 39.1 GHz and two oscillation sidebands sharply emerge at the offset frequency of −0.9 and 79.1 GHz, respectively. Meanwhile, under the condition of the optical modulation depth and microwave frequency used for the optical input in this demonstration, phase locking happens between the modulation sidebands of the optical input and the oscillation sidebands of the period-one nonlinear dynamical state. This imposes the laser cavity resonance red-shift effect experienced by the oscillation sidebands of the period-one nonlinear dynamical state onto the modulation sidebands of the optical input. On one hand, this results in considerable power amplification of the lower-frequency modulation sideband of the optical input as opposed to the upper-frequency modulation sideband of the optical input, thus forming an optical single-sideband modulation signal. On the other hand, this leads to a significant optical phase shift of the lower-frequency modulation sideband of the optical input, and in turn introduces a microwave phase shift and thus a microwave time delay to the microwave signal carried by the optical input, thus generating an optical output carrying a time-delayed microwave signal. If the microwave-time-delay laser 204 is operated at the stable injection locking dynamics to carry out the microwave time delay of the present invention, no phase-locking mentioned above is necessary.

As shown in FIG. 7, comparing the microwave spectra of the optical input and output shows that the microwave linewidths of the time-to-be-delayed microwave signal and the time-delayed microwave signal are the same, i.e., less than 1 Hz. This indicates that the spectral purity and stability of the microwave signal are mostly preserved after microwave time delay. Note that the microwave offset frequencies shown in the x-axis of FIG. 7 are relative to the modulation frequency of the optical input, $f_m$=40 GHz. In addition, as shown in FIG. 8, the phase noise of the time-to-be-delayed microwave signal and the time-delayed microwave signal is also the same, which further demonstrates that the spectral purity and stability of the microwave signal are indeed mostly preserved after microwave time delay.

FIG. 6 also shows that the power of the lower-frequency modulation sideband is considerably amplified after microwave time delay, which improves the optical modulation depth of the optical output close to 100%. Accordingly, as shown in FIG. 7, under the same optical power level received by the photodetector 302, the time-delayed microwave signal has a power 10.5-dB higher than the time-to-be-delayed microwave signal in this demonstration according to the preferred embodiment of the present invention.

Figure 9:
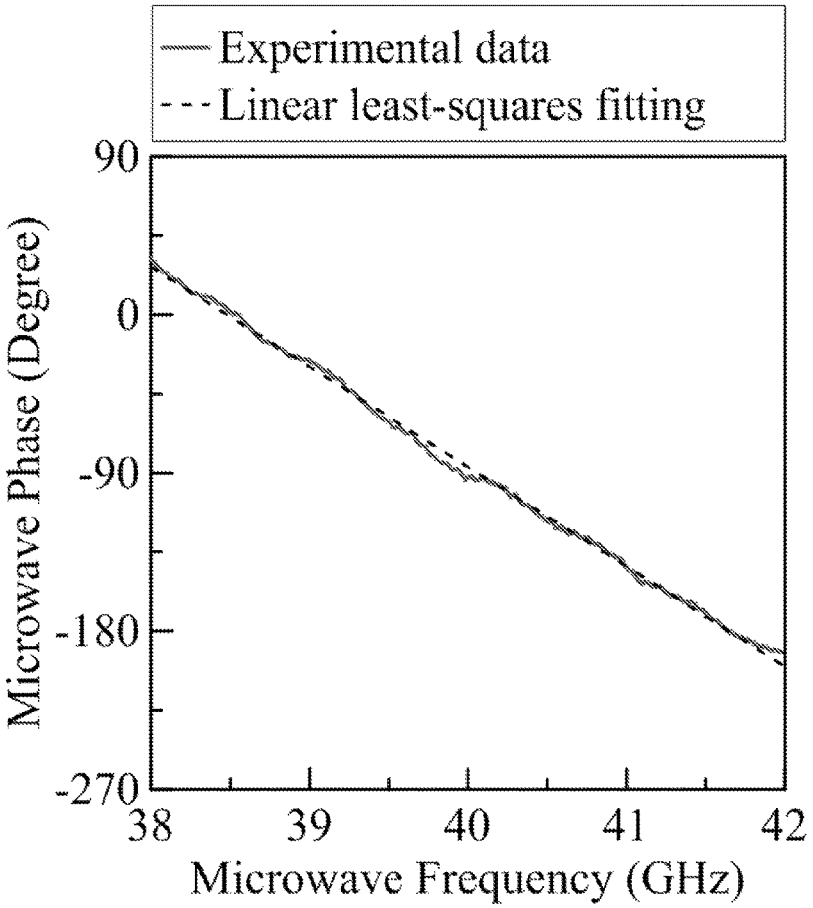
FIG. 9 shows microwave phase variation in terms of the microwave frequency after the microwave time delay process according to the preferred embodiment of the present invention.

Referring to FIG. 9, FIG. 9 shows microwave phase variation in terms of microwave frequency after the microwave time delay process according to the preferred embodiment of the present invention. For example, if the 40-GHz microwave signal mentioned above is used as a wireless carrier for data transmission, data typically occupies a frequency range around 40 GHz, i.e. the bandwidth of the data. To avoid the beam squint effect which reduces the wireless communication quality, any microwave time delay apparatus and method need to be capable of introducing the same level of the microwave time delay to a certain microwave frequency range around 40 GHz. A wider microwave frequency range a microwave time delay apparatus and method can provide, a higher data bandwidth the apparatus and method can process. As FIG. 9 shows, the photonic microwave time delay apparatus and the method of the present invention is capable of introducing a different microwave phase shift to a different microwave frequency, which is approximately linear over a certain frequency range, and which gives rise to a constant microwave time delay over such a frequency range. According to the preferred embodiment of the present invention, a microwave time delay of about 158 ps is estimated by calculating the slope of the linear least-squares fitting to the experimental data. Assuming that the average phase error between the experimental data and the linear fitting curve needs to be less than 2.3° required by a wireless communication network, the data bandwidth that the photonic microwave time delay apparatus and the method of the present invention can process is approximately 4 GHz in this example of demonstration. If the tolerance for the average phase error can be enhanced, a broader data bandwidth is available.

Figure 10:
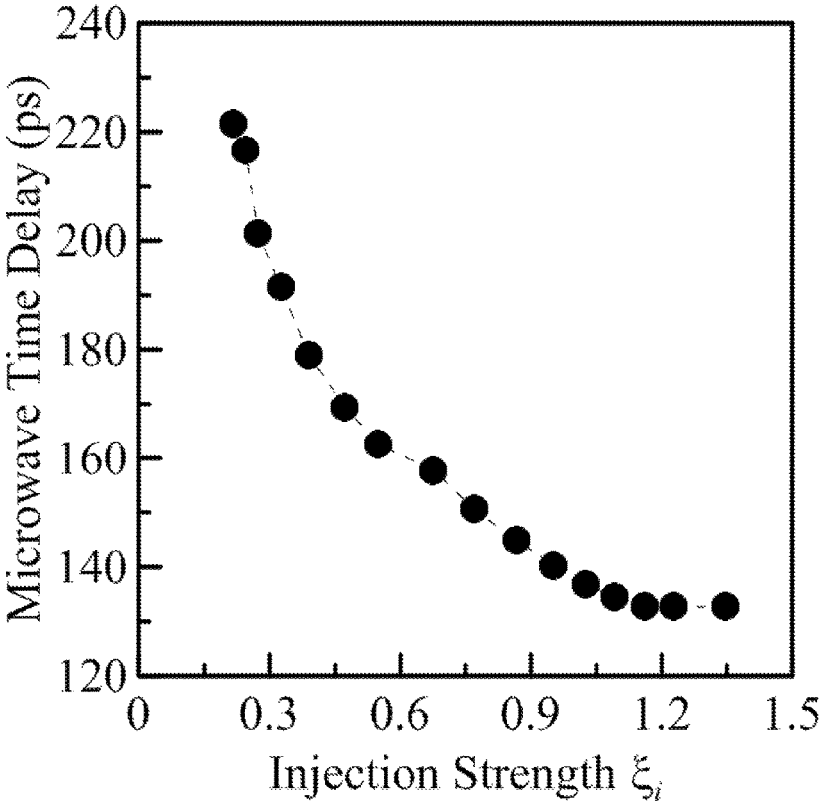
FIG. 10 shows microwave time delay in terms of the power of the optical input according to the preferred embodiment of the present invention.
Figure 11:
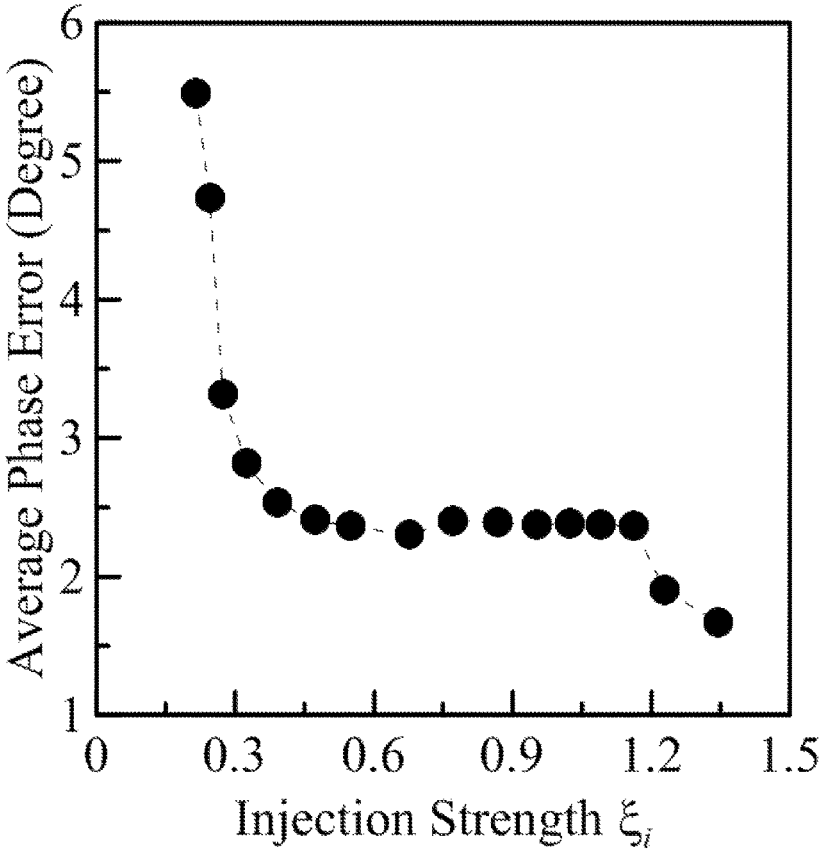
FIG. 11 shows average microwave phase errors in terms of the power of the optical input according to the preferred embodiment of the present invention.
Figure 12:
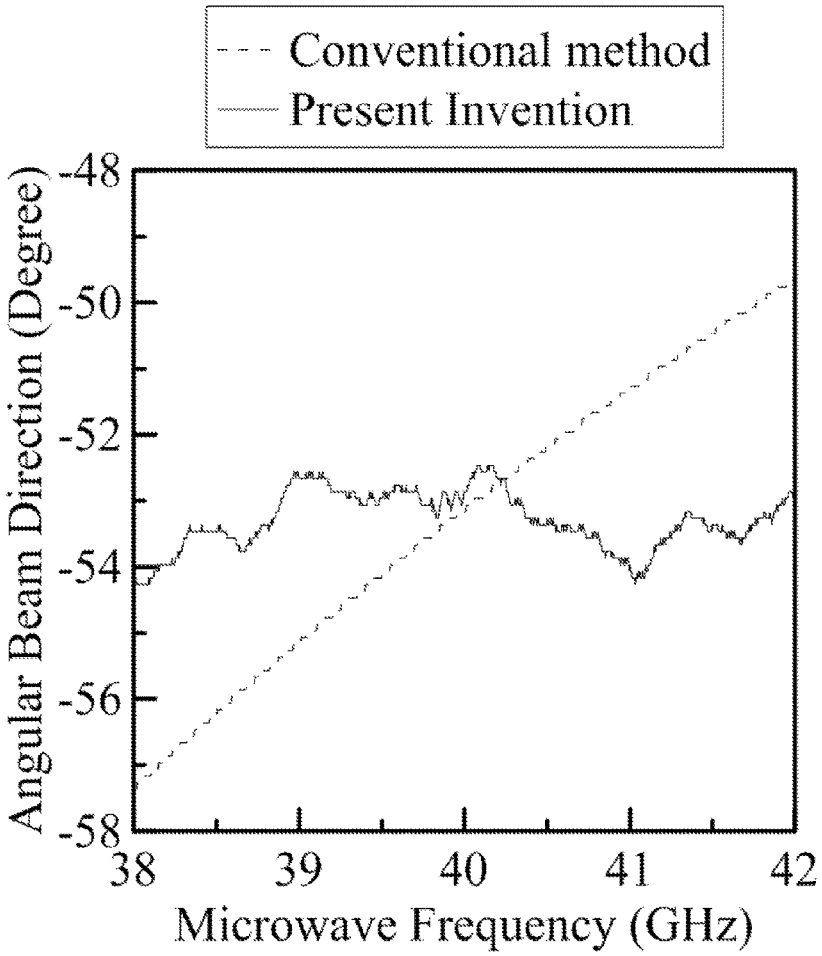
FIG. 12 shows beam pointing angle in terms of the microwave frequency according to the preferred embodiment of the present invention.

Referring to FIG. 10 to FIG. 12, FIG. 10 shows microwave time delay in terms of power of the optical input according to the preferred embodiment of the present invention. FIG. 11 shows average microwave phase errors in terms of power of the optical input according to the preferred embodiment of the present invention. FIG. 12 shows beam pointing angle in terms of microwave frequency according to the preferred embodiment of the present invention. The resolution of the beam pointing angle for a wireless communication system based on phased-array antennas depends on the number of the antennas used, and the maximum allowable number of the antennas is determined by the range of the microwave time delay. As mentioned above, adjusting $\xi_i$ or $f_i$ changes the extent of the laser cavity resonance red-shift effect, and in turn modifies the level of the optical phase shift around the lower-frequency oscillation sideband of the period-one dynamical state. This suggests that manipulating the optical power and carrier frequency of the optical input modifies the extent of the laser cavity resonance red-shift effect on the lower-frequency modulation sideband of the optical input, and in turn changes the level of the optical phase shift of the lower-frequency modulation sideband of the optical input. As a result, the level of the microwave phase shift and thus the microwave time delay of the microwave signal carried by the optical input can be adjusted accordingly. For example, as shown in FIG. 10, at $f_i$=39.1 GHz, a continuously tunable range of about 90 ps in microwave time delay can be achieved by continuously adjusting from 0.2 to 1.35. Within such a tunable range, the average phase errors between the experimental data and the linear fitting curve are kept below 6°, as shown in FIG. 11.

To demonstrate the superiority of the photonic microwave time delay apparatus and the method of the present invention, the level of the beam squint for the present invention and the conventional method (based on a constant microwave phase shift, not a constant microwave time delay) is estimated through simulating a 10×10 phased-array antenna system. The lower the level of the beam squint is, the higher the quality and efficiency of the wireless transmission are. For example, as shown in FIG. 12, the variation of the beam pointing angle reaches up to 8° within a microwave frequency range of 4 GHz around the microwave signal at 40 GHz for the conventional method, indicating a higher level of the beam squint. As a result, not only the quality and efficiency of the wireless transmission are considerably reduced, but also electromagnetic interference happens between nearby users using the same wireless channel. The variation of the beam pointing angle increases with the range of the microwave frequency under study, which makes the aforementioned phenomena even worse. On the contrary, by using the experimental data shown in FIG. 10 for the simulation, the variation of the beam pointing angle is found to keep within 2° over the same frequency range for the present invention, indicating a lower level of the beam squint and therefore considerably improving the quality and efficiency of the wireless transmission.

Even though the above explanations also describe the photonic microwave time delay method of the present invention, more explanations are provided as follows for further clarifications. Wherein, the details described above can be the reference in the photonic microwave time delay method of the present invention.

Figure 3:
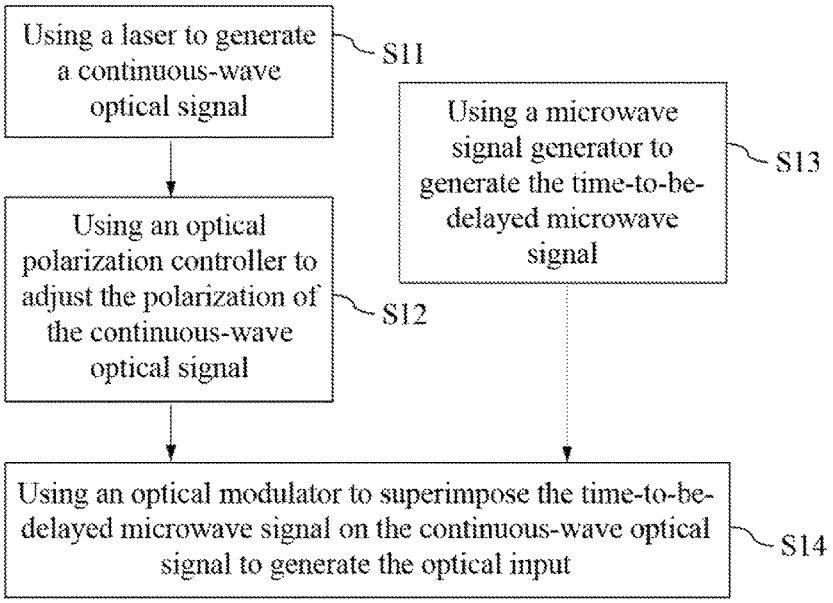
FIG. 3 is a second flow diagram showing the photonic microwave time delay method according to the preferred embodiment of the present invention.

Referring to FIG. 1 to FIG. 5, FIG. 2 is a first flow diagram showing a photonic microwave time delay method according to the preferred embodiment of the present invention. FIG. 3 is a second flow diagram showing the photonic microwave time delay method according to the preferred embodiment of the present invention. As shown in FIG. 1 to FIG. 5, the photonic microwave time delay method of the present invention uses a microwave-modulated optical signal generation module 10 to generate an optical input which is an optical signal carrying a time-to-be-delayed microwave signal (Step S10), and next sends the optical input generated by the microwave-modulated optical signal generation module 10 into a photonic microwave time delay module 20 including a microwave-time-delay laser 204. The optical power and carrier frequency of the optical input are adjusted so as to excite the laser cavity resonance red-shift effect in the microwave-time-delay laser 204. As a result, an optical output, which is an optical signal carrying a time-delayed microwave signal, is generated by the microwave-time-delay laser 204 (Step S24).

Step S10 may further include the following steps:

Step S11: using a laser 101 to generate a continuous-wave optical signal;

Step S12: using an optical polarization controller 102 to adjust the polarization of the continuous-wave optical signal;

Step S13: using a microwave signal generator 104 to generate the time-to-be-delayed microwave signal; and Step S14: using an optical modulator 103 to first receives the time-to-be-delayed microwave signal from the microwave signal generator 104 and the continuous-wave optical signal after polarization adjustment, and next to superimpose the time-to-be-delayed microwave signal onto the continuous-wave optical signal to generate the optical input.

Between Step S10 and Step S24, an optical power adjuster 201 can be used to adjust the optical power of the optical input generated by the microwave-modulated optical signal generation module 10 (Step S21). In addition, an optical polarization controller 202 can be used to adjust the polarization of the optical input after the power adjustment (Step S22).

Moreover, between Step S10 and Step S24, an optical path controller 203 can be used to unidirectionally direct the optical input toward the microwave-time-delay laser 204 (Step 23). Following Step S24, the same optical path controller 203 can be used to unidirectionally direct the optical output of the microwave-time-delay laser 204 toward an output port (Step 25).

Based on the aforementioned explanations and descriptions, the photonic microwave time delay apparatus and the method of the present invention uses a semiconductor laser as the microwave-time-delay laser 204. Without any external perturbation, the typical output of a semiconductor laser is a continuous wave of one single frequency. Injecting a continuous-wave optical signal generated by the laser 101 into the microwave-time-delay laser 204 induces the laser cavity resonance red-shift effect in the microwave-time-delay laser 204, which considerably changes the output behavior of the microwave-time-delay laser 204. The photonic microwave time delay apparatus and the method of the present invention take advantage of such an laser cavity resonance red-shift effect induced in the microwave-time-delay laser 204 operating at either the period-one nonlinear dynamics or stable injection locking dynamics to introduce a microwave phase shift and thus a microwave time delay to the microwave signal carried by an optical signal. The photonic microwave time delay apparatus and method of the present invention can be applied to introduce a microwave time delay to a microwave signal at a microwave frequency ranging from a few gigahertz to hundreds of gigahertz, and therefore can be dynamically reconfigured for different wireless communication networks adopting different microwave frequencies. In addition, the linewidth and phase noise of the time-delayed microwave signal are kept the same as those of the time-to-be-delayed microwave signal, making the apparatus and method of the present invention beneficial to wireless communication systems adopting advanced modulation formats for data transmission in order to further increase the communication capacity. Furthermore, the power of the microwave signal is significantly amplified after microwave time delay, which is advantageous in improving the detection sensitivity, fiber transmission distance, and link gain of a communication network. Moreover, after microwave time delay, the optical output possesses an optical single-sideband modulation feature, which is highly preferable for applications where fiber distribution of the optical output is necessary in order to mitigate microwave power fading. In addition, the level of the microwave time delay can be continuously adjusted through changing the power or carrier frequency of the optical input, which is beneficial not only to reduce the complexity of the system operation but also to continuously steer the beam pointing angle of phased-array antennas.

It should be understood that the present invention is not limited to the details thereof. Various equivalent variations and modifications may still occur to those skilled in this art in view of the teachings of the present invention. Thus, all such variations and equivalent modifications are also embraced within the scope of the present invention as defined in the appended claims.

What is claimed is:

1. A photonic microwave time delay apparatus, comprising:

an optical input, wherein the optical input is an optical signal carrying a time-to-be-delayed microwave signal;

an optical output, wherein the optical output is an optical signal carrying a time-delayed microwave signal; and a photonic microwave time delay module comprising a microwave-time-delay laser to convert the optical input into the optical output, wherein an optical power and a carrier frequency of the optical input are adjusted so as to excite a laser cavity resonance red-shift effect in the microwave-time-delay laser.

2. The photonic microwave time delay apparatus of claim 1, further comprising a microwave-modulated optical signal generation module to generate the optical input, wherein the microwave-modulated optical signal generation module comprises:

a laser, generating a continuous-wave optical signal;

an optical polarization controller, adjusting a polarization of the continuous-wave optical signal;

a microwave signal generator, generating the time-to-be-delayed microwave signal; and an optical modulator, superimposing the time-to-be-delayed microwave signal on the continuous-wave optical signal to generate the optical input.

3. The photonic microwave time delay apparatus of claim 1, wherein the photonic microwave time delay module further comprises:

an optical power adjuster, adjusting the optical power of the optical input; and an optical polarization controller, adjusting a polarization of the optical input.

4. The photonic microwave time delay apparatus of claim 3, wherein the optical power adjuster further comprises an active optical device or a passive optical device, and wherein the active optical device is an optical power amplifier and the passive optical device is an optical power attenuator.

5. The photonic microwave time delay apparatus of claim 1, wherein the photonic microwave time delay module further comprises:

an optical path controller, connected to the microwave-time-delay laser, to unidirectionally direct the optical input toward the microwave-time-delay laser and to unidirectionally direct the optical output toward an output port of the photonic microwave time delay apparatus.

6. The photonic microwave time delay apparatus of claim 5, wherein the optical path controller is an optical circulator, and the microwave-time-delay laser is a semiconductor laser.

7. A photonic microwave time delay method, comprising steps of:

using a microwave-modulated optical signal generation module to generate an optical input, wherein the optical input is an optical signal carrying a time-to-be-delayed microwave signal; and using a photonic microwave time delay module to convert the optical input into an optical output, wherein the photonic microwave time delay module comprises a microwave-time-delay laser, wherein an optical power and a carrier frequency of the optical input are adjusted so as to excite a laser cavity resonance red-shift effect in the microwave-time-delay laser, and wherein the optical input is an optical signal carrying a time-delayed microwave signal.

8. The photonic microwave time delay method of claim 7, wherein the step of using the microwave-modulated optical signal generation module to generate the optical input comprises steps of:

using a laser to generate a continuous-wave optical signal;

using an optical polarization controller to adjust a polarization of the continuous-wave optical signal;

using a microwave signal generator to generate the time-to-be-delayed microwave signal; and using an optical modulator to superimpose the time-to-be-delayed microwave signal on the continuous-wave optical signal to generate the optical input.

9. The photonic microwave time delay method of claim 7, further comprising steps between the step of using the microwave-modulated optical signal generation module to generate the optical input and the step of using the photonic microwave time delay module to convert the optical input into the optical output of:

using an optical power adjuster to adjust the optical power of the optical input; and using an optical polarization controller to adjust a polarization of the optical input.

10. The photonic microwave time delay method of claim 7, wherein the step of using the photonic microwave time delay module to convert the optical input into the optical output further comprises:

using an optical path controller to unidirectionally direct the optical input toward the microwave-time-delay laser and to unidirectionally direct the optical output toward an output port of the photonic microwave time delay apparatus.

* * * * *